US005428842A

United States Patent [19]

Wise

[11] Patent Number: 5,428,842

[45] Date of Patent: Jul. 4, 1995

[54] HAT MADE OF UNITARY SHEET OF CARDBOARD OR THE LIKE

[76] Inventor: Herbert H. Wise, 7649 Woodrow Wilson Dr., Los Angeles, Calif. 90046

[21] Appl. No.: 980,471

[22] Filed: Nov. 20, 1992

[51] Int. Cl.[6] ..... A42B 1/00

[52] U.S. Cl. ..... 2/195.1; 2/200.1; 2/200.3

[58] Field of Search ..... 2/171, 171.1, 171.4, 2/171.5, 171.7, 171.8, 172, 175, 184.5, 192, 195, 197, 200, 209.3, 175.1, 195.1, 200.1, 200.3

[56] References Cited

U.S. PATENT DOCUMENTS

| | | | |
|---|---|---|---|
| 1,598,379 | 8/1926 | Kerr | 2/209.3 |
| 2,682,668 | 7/1954 | Hoeflich | 2/200 |
| 2,787,791 | 4/1957 | Linney | 2/200 |
| 2,988,743 | 6/1961 | Wagenfeld | 2/197 |

FOREIGN PATENT DOCUMENTS

| | | | |
|---|---|---|---|
| 133138 | 2/1985 | European Pat. Off. | 2/195 |
| 847337 | 10/1939 | France | 2/200 |
| 710428 | 9/1941 | Germany | 2/195 |

*Primary Examiner*—Clifford D. Crowder
*Assistant Examiner*—Diana L. Biefeld
*Attorney, Agent, or Firm*—Lawrence S. Cohen; Freilich, Hornbaker & Rosen

[57] ABSTRACT

A cap being formed of thin flexible self supporting material cut to shape and assembled, having a band portion, overlapped lobes to form a crown, and a visor and a blank thereof.

11 Claims, 2 Drawing Sheets

HAT MADE OF UNITARY SHEET OF CARDBOARD OR THE LIKE

BACKGROUND

This invention relates to caps. More specifically it relates to caps having a crown, a band and a visor.

There are many styles of caps. A common style is called a baseball cap. While this description is not exact in describing a cap configuration, in general it describes a cap having a fairly large visor and full crown.

Baseball caps are now high fashion. They became street fashion when rap artists adopted this sign of youth. The fashion crowd hastily added the cap to its uniform of white T shirts and sneaker.

According to a consultant to the headwear industry roughly 300 million baseball caps were made in the United States in 1990. An equal number were imported from China, Hong Kong, Taiwan and South Korea.

Seventy percent of all hats sold in America are baseball caps, according to the Headwear Institute of America. Caps are having a record season (1991). The institute estimates that sales of all hats will reach $2.2 billion this year (1991) and increase of ten percent over last year.

Part of the baseball caps' appeal is that they are unisex and they are relatively inexpensive. Fifty percent of the caps sold are premiums or promotional in nature and advertise everything from seed and feed companies to fast food and amusement parks.

One company, New Ear Cap of Derby, N.Y. makes several million caps including the official cap of 23 of the 26 major league baseball teams.

The official cap has six pieces in the crown (each with an eyelet for ventilation) and a visor three inches long and seven and a half inches wide. Hollywood's version, as worn by Tom Cruise in "Top Gun" has a somewhat longer bill for dramatic purposes.

The design of the baseball cap has remained basically unchanged over the last three quarters of a century. The bill is slightly longer now than it was before World War II, and in the past twenty years the crown has been stiffened and raised a bit in front which reduces the skullcap effect.

SUMMARY OF THE INVENTION

In its preferred embodiment, the invention relates to a baseball cap. But, the invention can be applied to other styles. It could be implemented in an embodiment having no visor.

The cap of the present invention has three primary parts, a band, a crown and a visor. It is made from one piece of self supporting flexible material which can be bent along a specific line.

The cap is preferably formed from one piece, the preferred material being heavy paper, card stock, or chipboard. Plastic could also be used.

The cap is formed from a single piece which can be die cut or otherwise shaped. A band has ends which are joinable and preferably joinable to a selectable size. From the band a series of lobes extend upwardly. The lobes have overlapping portions which can be joined to form a crown. Preferably the lobes are formed in mating pairs, the pair members joining. At least the outermost pair are joined by a detent means so that they will remain fixed and thereby hold the underlapped lobes in place. The visor extends from the lower side of the band. It is scored to be bent to form a shallow curve.

The visor could be made of a separate piece joined to the band, or the cap could be made omitting the visor.

DESCRIPTION OF THE INVENTION

Figure 1:
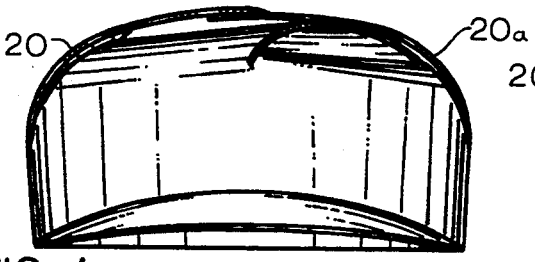
FIG. 1 is a front view of the preferred embodiment of the cap.
Figure 5:
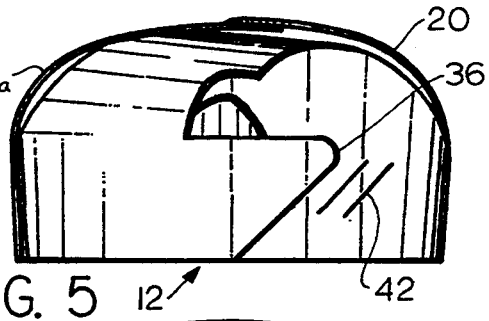
FIG. 5 is a back view of the cap of FIG. 1.
Figure 2:
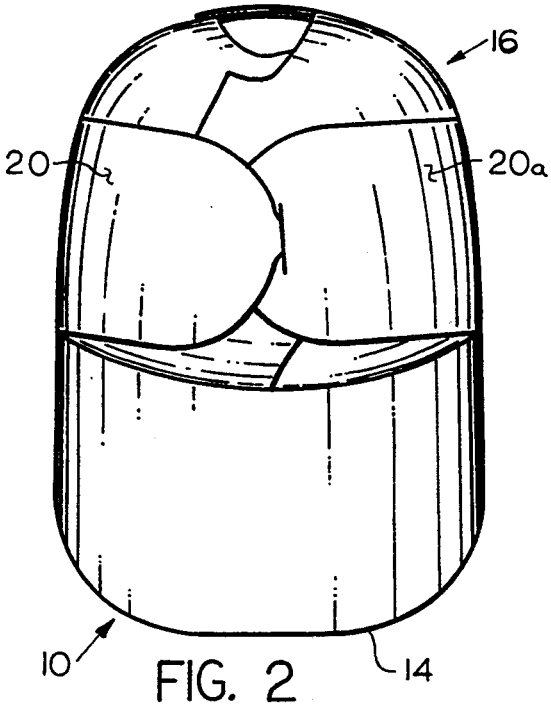
FIG. 2 is a top view of the cap of FIG. 1.
Figure 6:
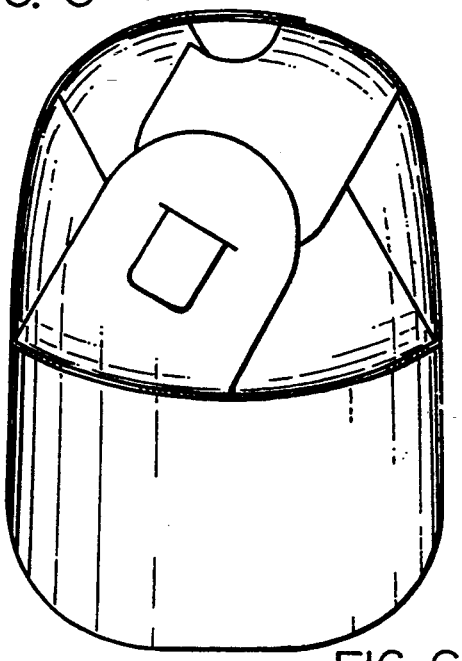
FIG. 6 is a bottom view of the cap of FIG. 1.
Figure 3:
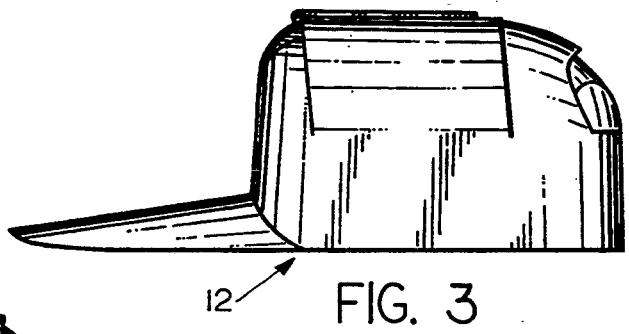
FIG. 3 is a right side view of the cap of FIG. 1.
Figure 4:
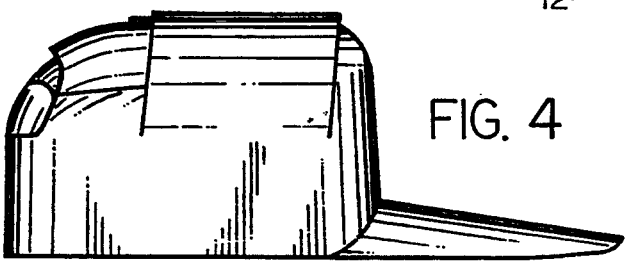
FIG. 4 is a left side view of the cap of FIG. 1.
Figure 7:
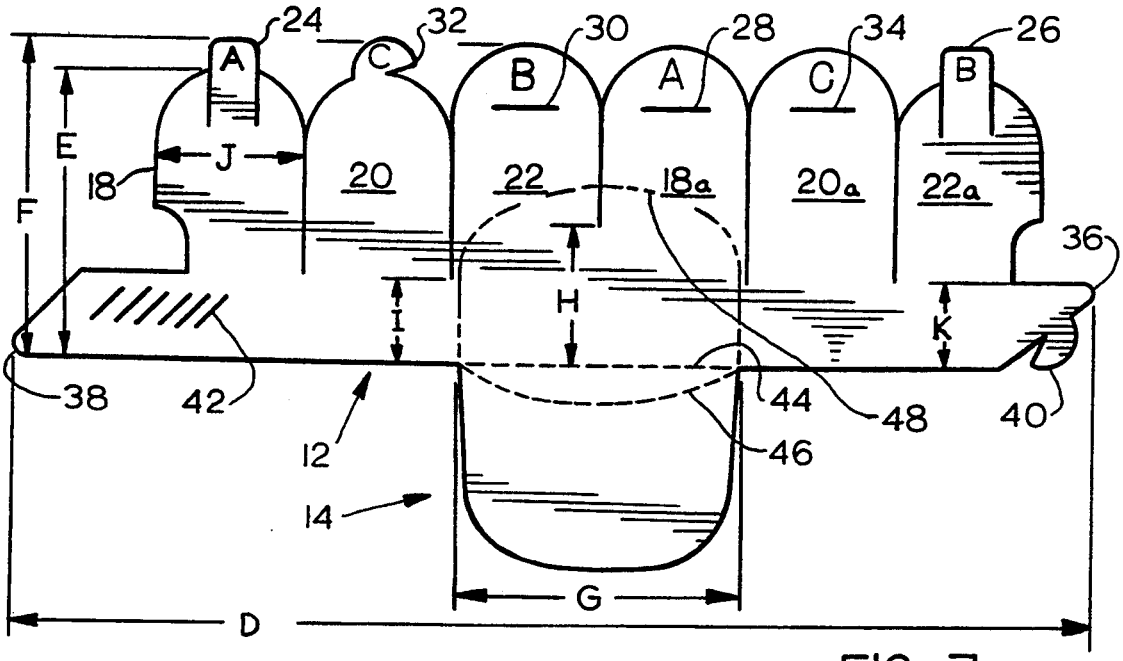
FIG. 7 is a plan view of the blank to be formed into the cap, showing the visor in its initial position as part of the blank, and in phantom lines, its second position.
Figure 8:
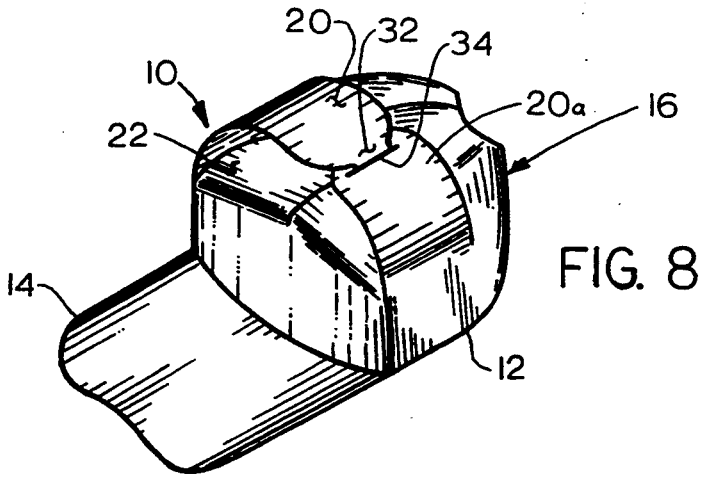
FIG. 8 is a perspective view of the cap fully formed.

Referring to the Figures the cap 10 has three main elements, the band 12, the visor 14 and a series of lobes to form crown 16. In this embodiment there are six lobes, which comprise three pairs 18 and 18*a*, 20 and 20*a*, 22 and 22*a*. The cap 10 is formed from a blank which contains all the parts of the cap in a single piece of self-supporting flexible material. As seen in FIG. 7 the lobe pairs are marked A, B and C in order to aid in assembly of the cap 10 as will be described below. The lobes 18 and 22*a* have non-detented tabs 24 and 26 respectively which will enable their joinder with their respective mating lobes 18*a* and 22 by the tabs 24 and 26 sliding into the slits 28 and 30 respectively. The lobe 20 has a detent member 32 which will engage in the slit 34 of lobe 20*a*.

Referring to FIG. 7 the band 12 has a first end 36 and a second end 38. Each end has one part of mating joinder elements. The first end 36 has a joinder element comprising a detent tab 40 while the second end has a mating joinder element comprising a series of angled slits 42. The visor 14 extends downwardly from the band, directly opposite the lobes 22 and 18*a*. Scoring 44 and 46 extend between the visor 14 and the band 12 the full width of the visor 14. Score 44 extends directly across the line of the bottom of the band 12, while score 46 extends in an arc curving downward into the visor.

Preferably the cap is made of card stock, such as 10 point coated cover stock. It can be colored or printed on the outside, a solid color, a bright "neon" color, or a pattern. Thin plastic could also be used, in which case the scoring would be formed in the plastic.

The following steps describe assembly of the cap 10 from the blank as shown in FIG. 7.

First, the visor 14 is bent up along the score line 44 into the position indicated by the phantom lines 48 in FIG. 7.

Next, the band ends are joined, the detent tab 40 being inserted into a selected one of the slits 42. The selection of the slit 42 provides the size of the cap 10, appropriate to the user's head size.

Next, the lobes are sequentially joined in pairs. The pairs 18 and 18*a* go first into overlapping relationship, lobe 18 being on top, with the tab 24 entering the slit 28. Then the pair 22 and 22 are joined, the lobe 22 being on top so that its detent member 26 can be inserted into the slit 30 of lobe 22. The order of these two lobe pairs is functionally interchangeable. Note that lobes 22 and 18*a* will form the front portion of the crown rising symmetrically above the visor 14 to form the crown 16.

Then the third pair of lobes 20 and 20 are overlapped on the first two pairs, with lobe 20 on top so that detent 32 can be inserted in slit 34 of the lobe 20*a*.

Then the visor 14 is bent downward on the score 46 to form a compound curve of the visor 14 intersecting the curve of the band 12. The visor 14 could be formed before the lobes are overlapped or before the last pair are joined.

In this embodiment there are two lobes 22 and 18*a* centered symmetrically above the visor 14. Also, the lobes 20 and 20*a* extend, when the cap is formed, from opposite sides overlapping on top, over the other lobes. The band joinder elements 40 and 42 are at the back, opposite the visor 14.

A unique feature of this cap is its being made from a single piece of thin self-supporting flexible material. The material is also capable of defining a line of bend to enable formation of the visor as at the scoring 44 and 46.

The tabs 24 and 26 are non-detent, capable of sliding in their respective slits 28 and 20. This facilitates assembly and shaping the cap. Tabs 24 and 26 can slide in their slits 28 and 32 to accommodate to the size of the cap as determined by the choice of slit 42 to receive detent 40 in the band 12 as well as to enable shaping of the crown particularly as the last two lobes 20 and 20*a* are fitted by detent 32 in slit 34. However, detents could be used such as detent 32 although the slidable tabs are preferred.

In the presently preferred embodiment, the cap blank has the following primary dimensions:

D=26 7/8
E=7 3/16 (typ.)
F=7 ¾ (typ.)
G=7 3/16
H=3½
I=2 3/16
J=3¾ (typ.)
K=2⅛

Although paired lobes are used in the preferred embodiment, other arrangements are possible. For example, by moving the joinder elements of the band from the back to the side, a single lobe could extend from the back to join with the two lobes from the front. Also, the cap could be formed with only the two side lobes, having none at the front or rear or having none at the rear. There could be more than 3 pairs of lobes. The lobes could be different in width (J) such as pairs having different widths, or other combination of widths.

Also, the lobes, instead of being joined by joining specified other lobes, could all be held together by a fastener extending from the innermost lobe to the outermost lobe, through aligned holes in the lobes. For example, a hook and loop fastener could be used.

The order of assembling lobes to be joined, whether in pairs or other combinations, can be selected to provide a semi-rigid crown structure. In the above described embodiment, for example the side lobes 20, 20*a* are on top. But, it could also be modified to place lobes 22, 22*a* or 18, 18*a* on top.

The band joining elements could be any type of such element, such as a hook and loop fastener.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A cap comprising;

a single piece of thin flexible self-supporting material comprising;

an elongated band portion having a first and a second end, said ends each having a joining element defining band joining elements which are joined together for mutual joining when the ends are brought together to form a closed curved cap band;

a visor portion extending from a first side of the band portion; and an even number of adjacent lobes of equal width and having free ends arranged to extend from a second side of the band portion opposite said first side and said lobes being mated in discrete pairs and said pairs of lobes being discretely joined to each other by engagement of a joinder element on one lobe proximate its free end to a mating joinder element on the other lobe proximate its free end, and said pairs of lobes being arranged in a sequence of overlapping pairs defining an outermost overlapping pair.

2. The cap of claim 1 wherein at least the outermost overlapping pair has detent joining elements to hold said lobe pair together.

3. The cap of claim 1 wherein there are six lobes defining 3 lobe pairs.

4. The cap of claim 3 wherein a first two of said lobes extend from opposite the visor, and being adjacent generally at the center of the visor.

5. The cap of claim 4 wherein the other four of said lobes are arranged two on each side of said first two lobes.

6. The cap of claim 5 wherein said first two lobes will each pair with the outermost lobe on the opposite side and the two lobes directly adjacent said first two lobes will pair with each other.

7. The cap of claim 6 wherein said paired lobes will be joined by one lobe having as its joinder element a slit and the other having as its joinder element an extension member which enters the slit when the cap is formed.

8. The cap of claim 7 wherein the band joining elements comprises at least one slit at one end and an extension member which enters the slit when the cap is formed.

9. The cap of claim 7 wherein at least one of said extension members has a detent portion which engages the opposite lobe against opening.

10. The cap of claim 7 wherein the extension member of the lobe of the outermost overlapping pair of lobes has a detente on one lobe fitable into a slit in the other lobe of said last to be overlapped pair of lobes to hold them in overlapped position.

11. The cap of claim 1 further comprising means to retain said lobes in overlapped position forming a crown.

* * * * *